US005650801A

United States Patent [19]

Higashi

[11] Patent Number: 5,650,801

[45] Date of Patent: Jul. 22, 1997

[54] DRIVE CIRCUIT WITH RISE AND FALL TIME EQUALIZATION

[75] Inventor: Masahiko Higashi, Ami-machi, Japan

[73] Assignee: Texas Instruments Japan, Ltd., Japan

[21] Appl. No.: 484,744

[22] Filed: Jun. 7, 1995

[30] Foreign Application Priority Data

Jun. 7, 1994 [JP] Japan ..... 6-148571

[51] Int. Cl.[6] ..... G09G 3/00

[52] U.S. Cl. ..... 345/210

[58] Field of Search ..... 345/87, 91, 92, 345/94, 95, 210; 307/475

[56] References Cited

U.S. PATENT DOCUMENTS 4,917,467 4/1990 Chen et al. ..... 345/87 X 5,113,097 5/1992 Lee ..... 307/475

*Primary Examiner*—Mark R. Powell

*Attorney, Agent, or Firm*—David S. Guttman; W. James Brady, III; Richard L. Donaldson

[57] ABSTRACT

A drive circuit in which the rise and fall characteristics with multiple voltages are made the same, while maintaining a high breakdown voltage. Drive circuit 70, which supplies power supply voltages VH and VL and voltage VM intermediate between them to output pad 32, is composed of p-channel MOS transistor P5 and n-channel MOS transistors N5, N6 and N7. When the output voltage changes from VH to VM, both transistors N6 and N7 conduct, and when the output voltage changes from VL to VM, only transistor N6 conducts. The transistors that supply intermediate voltage VM are constructed of transistors of the same conductivity type, so that the rise and fall characteristics to VM can be made the same while the breakdown voltage of the transistors in the circuit that supplies this intermediate voltage VM is kept high.

3 Claims, 6 Drawing Sheets

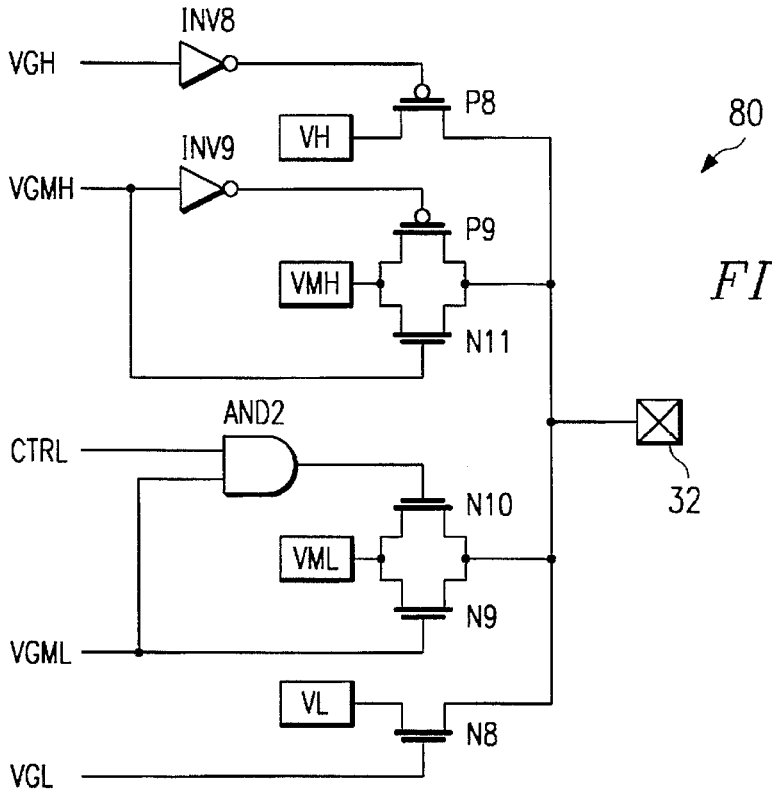
FIG. 8
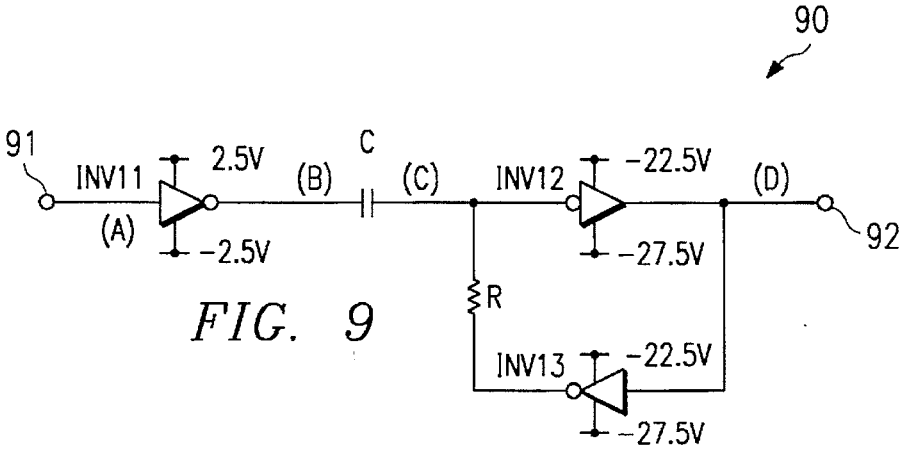
FIG. 9
FIG. 10
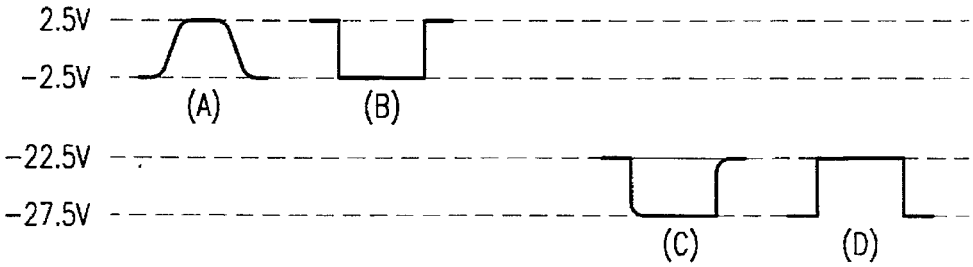

DRIVE CIRCUIT WITH RISE AND FALL TIME EQUALIZATION

FIELD OF THE INVENTION

This invention relates to drive circuits for displays, and more particularly to a drive circuit for a flat panel display, such as a liquid crystal display (LCD) panel.

BACKGROUND OF THE INVENTION

Flat panel displays are used as displays for computers, etc. There are various types of flat panel displays, and LCDs that use liquid crystals are widely used. A simple matrix liquid crystal display panel is representative of these.

FIG. 11 shows a sketch of a simple matrix LCD panel. This simple matrix LCD panel 10, as shown in FIG. 11, is constructed from liquid crystals sandwiched by scanning electrodes X1, X2, . . . , XN and signal electrodes Y1, Y2, . . . , YM, and each point of intersection of scanning electrodes X and signal electrodes Y constitutes a pixel.

FIG. 12 shows a block diagram of a simple matrix LCD panel device. This simple matrix LCD panel 20 is composed of a simple matrix LCD panel 10, scanning electrode drivers C1, . . . , Cn, signal electrode drivers S1, S2, . . . , Sm, a controller 12 that controls scanning electrode drivers C and signal electrode drivers S, and a power supply 16.

LCD panel 10 transmits display signals to each pixel by scan-driving (time allocation driving) and constitutes a screen. That is, one line is displayed by sending the relevant display signal from signal electrodes Y to the column selected by scanning electrode X. The selected signals are scanned sequentially from the top and one frame (screen) is scanned per cycle.

FIG. 13 shows an example of the voltage waveforms applied to scanning electrodes X and signal electrodes Y of LCD panel 10 in a 6-level drive method. In FIG. 13, (a) is the voltage waveform applied to scanning electrodes X, (b) and (c) are voltage waveforms applied to signal electrodes Y, and (d) is a voltage waveform (absolute value) applied to each pixel.

Here, data output from controller 12 to scanning electrode drivers C and signal electrode drivers S are signals with a logical amplitude of 0–5 V. 0 V, 2.5 V, 5 V, 27.5 V and 30 V are fed to scanning electrode drivers C, and 0 V, 5 V, 25 V and 30 V are fed to signal electrode drivers S.

The 6-level drive method of a simple matrix LCD panel using the voltage waveforms in FIG. 13 will be explained below. Note that to simplify the explanation the display on LCD panel 10 will have two values: on/off (white/black).

When liquid crystal material is driven by direct current, ions accumulate on one side, thus the liquid crystal material is quickly degraded, so it must be driven by alternating current. Thus, as shown in FIG. 13(*a*), for scanning electrodes X there are two nonselection voltages of 2.5 V and 27.5 V and two selection voltages of 30 V and 0 V. Also, as shown in FIGS. 13(*b*) and (*c*), for signal electrodes Y there are two nonselection (pixel off) voltages of 5 V and 25 V and two selection (pixel on) voltages of 0 V and 30 V. The turning on/off of each pixel is controlled by combining each of the voltages stated above. The selection voltage of a signal electrode Y is 0 V when the selection voltage of a scanning electrode X is 30 V, and the selection voltage of a signal electrode Y is 30 V when the selection voltage of a scanning electrode X is 0 V. Therefore, application of 30 V at the pixel located at the point of intersection of the scanning electrode X and signal electrode Y will turn on the given pixel. On the other hand, the nonselection voltage of a signal electrode Y is 5 V when the selection voltage of a scanning electrode X is 30 V, and the nonselection voltage of a signal electrode Y is 25 V when the selection voltage of a scanning electrode X is 0 V. Therefore, a voltage of 25 V is applied to the corresponding pixel, and the given pixel will be off. Also, when the 2.5 V nonselection voltage is applied to each scanning electrode X, 0 V or 5 V will be applied to each signal electrode Y, and when the 27.5 V nonselection voltage is applied to each scanning electrode X, 25 V or 30 V will be applied to each signal electrode Y. Therefore, a voltage of 2.5 V will be applied to each pixel of each scanning electrode X that is not selected, and each of the given pixels will remain off. As shown in FIG. 13, each voltage of 0 V, 2.5 V, 27.5 V and 30 V must be applied to scanning electrodes X, and each voltage of 0 V, 5 V, 25 V and 30 V must be applied to signal electrodes Y, so that scanning electrode drivers C and signal electrode drivers S require a drive circuit whose output voltage range is 0–30 V, that is, a high breakdown voltage transistor. Generally, control data from controller 12 that controls scanning electrode drivers C and signal electrode drivers S, are 5 V system (0–5 V signal amplitude) signals. Therefore, a level shift circuit must be installed inside scanning electrode drivers C and signal electrode drivers S and the 5 V system signals converted to logical amplitude signals of 0–30 V.

A high breakdown voltage transistor that outputs a voltage of up to 30 V requires a relatively large area on an IC chip, so that the area of the driver IC chip that composes scanning electrode drivers C and signal electrode drivers S will become greater, and this is one cause of the increased cost of scanning electrode drivers C and signal electrode drivers S. Also, the scanning electrode drivers C and signal electrode drivers S require a level shift circuit, so that the increase in IC chip area caused by this level shift circuit will increase the cost of scanning electrode drivers C and signal electrode drivers S.

A typical simple matrix LCD panel 10 has a 640×480 dot construction, so that 480 scanning electrodes X are needed in a black-and-white LCD panel, and 640 signal electrodes Y are needed. On the other hand, in color LCD panels, three R, G, and B signal electrodes Y are needed for one pixel, so that 480 scanning electrodes X are needed, and 1920 signal electrodes Y are needed. When the LCD panel becomes large and highly precise in this way, the number of signal electrodes Y will be very large, compared to the number of scanning electrodes X. Therefore, as the number of signal electrodes Y increases, the number of signal electrode drivers S of simple matrix LCD device 20 will increase, and the cost of display device 20 will increase because of the increased number of signal electrode drivers S.

Therefore, an object of the present invention is to provide a drive circuit where the area the circuit forms on an IC chip is small.

Also, an object of the present invention is to provide a drive circuit suitable for liquid crystal panel display devices.

SUMMARY OF INVENTION

The drive circuit of the present invention is formed on a principal face of a semiconductor region of a first conductivity type where a first voltage is applied. It has first and second transistors that feed a third voltage approximately intermediate between a second voltage and the first voltage, or a fourth voltage between the third voltage and the first voltage, to an output terminal by conducting. When the third or fourth voltage is fed to the output terminal that is at an electrical potential closer to the second voltage than the third or fourth voltage, both the first and second transistors conduct. When the third or fourth voltage is fed to the output terminal that is at a potential closer to the first voltage than the third or fourth voltage, one of the first or second transistors conducts.

In a circuit that feeds multiple voltages, for example, a first voltage (ground potential: Vss), a second voltage (power supply potential: Vcc) and a third voltage intermediate between the first voltage and the second voltage, to an output terminal, particularly in a drive circuit that drives a LCD panel, it is desirable to make the rise and fall characteristics between each of these voltages the same.

It is very difficult to make the rise characteristics to a third voltage intermediate between a first voltage and a second voltage and the fall characteristics to the third voltage the same using one MOS transistor. Therefore, the circuit portion that feeds the third voltage to the output terminal should be constructed with a transistor having a CMOS structure.

A CMOS structure cannot be formed in a semiconductor region of the same conductivity type. Therefore, when a transistor of one conductivity type is formed on a silicon substrate, a transistor of the other conductivity type must be formed in a well (tank) region formed on the substrate, and first and second voltages are applied, respectively, to the substrate and the well region as transistor gate reverse bias voltages. In a CMOS structure, the well region must be formed on the substrate in this way, so that the area where the circuit is formed will be relatively large. Also, the impurity concentration in the well region will be higher than the impurity concentration of the substrate, so that the breakdown voltage of the transistor formed in the well region will be lower than if it were formed on the substrate.

The drive circuit of the present invention includes first and second transistors formed on a principal face of a semiconductor region of the same conductivity type as the circuit that feeds a third voltage (or fourth voltage) to an output terminal. When the third voltage is fed to an output terminal that is at a potential closer to the second voltage Vcc than the third voltage, both the first and second transistors will conduct, and when the third voltage is fed to an output terminal that is at a potential closer to the first voltage Vss than the third voltage, the first or second transistors will conduct. Therefore, it will be easy to made the rise and fall characteristics to a third voltage at an output terminal the same without using a CMOS structure.

Also, since the first and second transistors are formed on a principal face of a semiconductor region of the same conductivity type, it will be possible to prevent reduction in breakdown voltage caused by forming one transistor in a well region.

BRIEF DESCRIPTION OF THE DRAWINGS

FIG. 8 shows a second embodiment of a drive circuit according to the present invention.

FIG. 9 shows a level shift circuit of a level shifter 14 in FIG. 1.

FIG. 10 shows signal voltage waveforms at each node (A), (B), (C) and (D) of the level shift circuit of FIG. 9.

Also in the figures, 10 is a simple matrix LCD panel, 12, 13 are controllers, 14 is a level shifter, 15, 16 are power supplies, 30, 60, 70, 80 are drive circuits, 50 is a p-type silicon substrate, 51 an n-type well, 52, 55 are drains, 53, 56 are sources, 54, 57 are gates, 58, 59 are channels, 90 is a level shift circuit, P1, P2, P3, P5, P8, P9 are p-channel MOS transistors, N1–N11 are n-channel MOS transistors, INV1, INV2, INV3, INV5, INV8, INV9 are inverters, and AND1, AND2 are AND gates.

DESCRIPTION OF EMBODIMENTS

Figure 1:
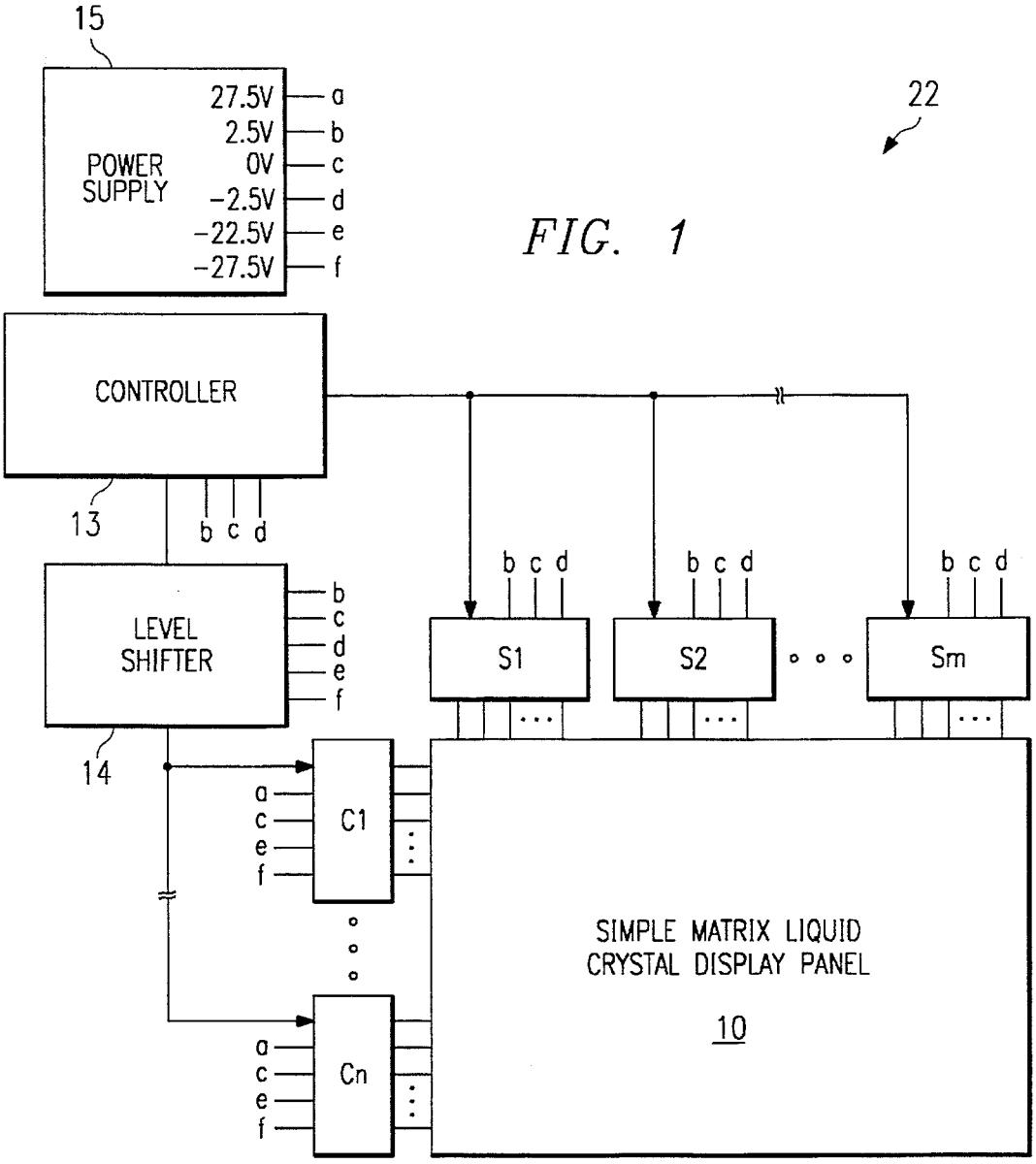
FIG. 1 is a block diagram of a simple matrix LCD panel device that pertains to the present invention.

FIG. 1 is a block diagram of a simple matrix LCD panel device that pertains to the present invention. This simple matrix LCD panel device 22 is composed of a simple matrix LCD panel 10, scanning electrode drivers C1, . . . , Cn, signal electrode drivers S1, S2, . . . , Sm, a controller 13 that controls scanning electrode drivers C and signal electrode drivers S, a level shifter 14 that feeds signals from controller 13 to scanning electrode drivers C as level shifts, and a power supply 15. LCD panel 10 of this display device 22 transmits display signals to each pixel by scan-driving and composes the screen.

Figure 2:
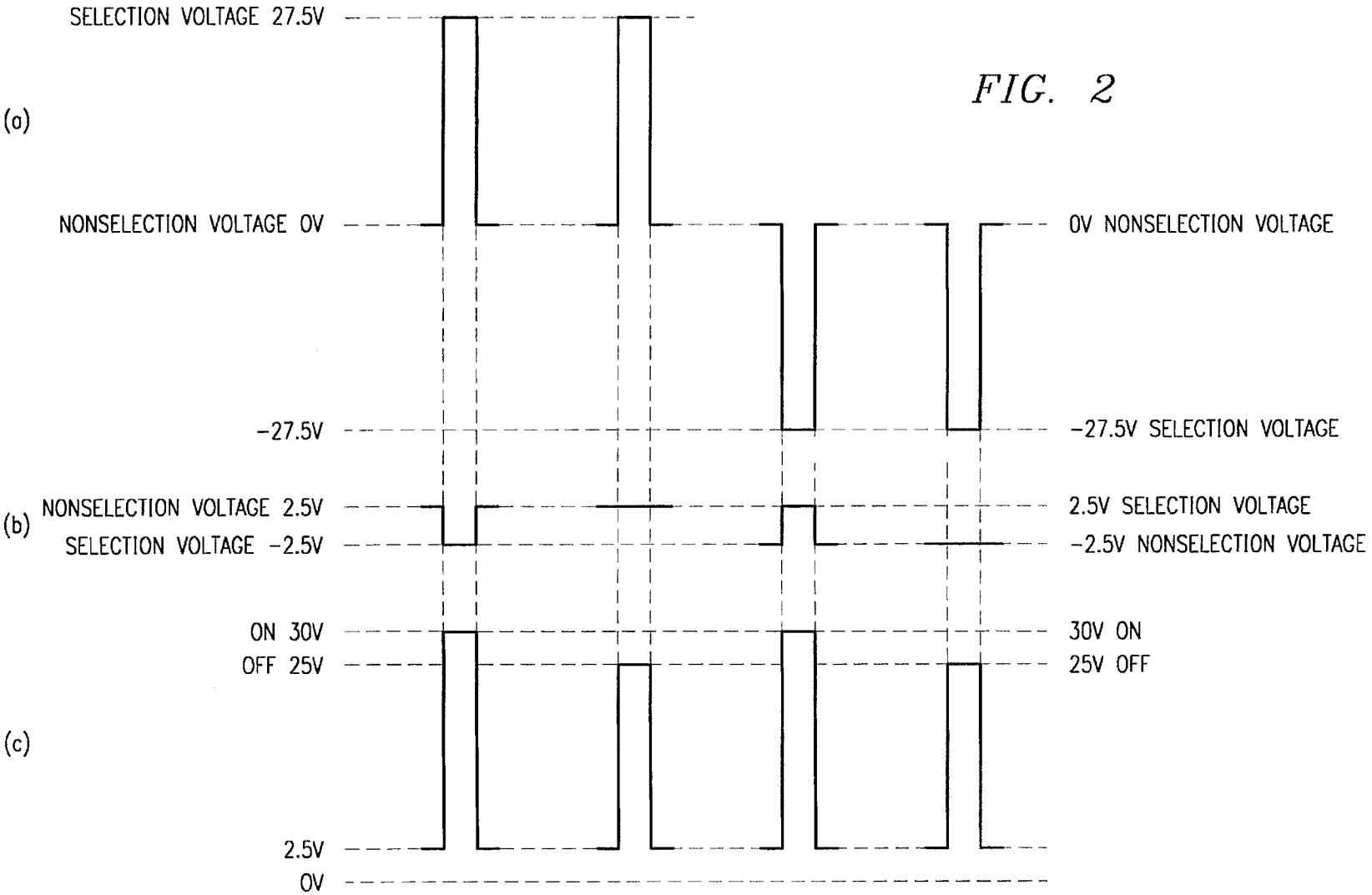
FIG. 2 shows an example of voltage waveforms applied to scanning electrodes X and signal electrodes Y of a simple matrix LCD panel device that pertains to the present invention.

FIG. 2 shows an example of the voltage waveforms applied to scanning electrodes X and signal electrodes Y in a simple matrix LCD panel device that pertains to the present invention. In FIG. 2, (a) represents voltage waveforms applied to scanning electrodes X, (b) represents voltage waveforms applied to signal electrodes Y, and (c) represents voltage waveforms (absolute values) applied to each pixel.

Here data output from controller 13 to level shifter 14 and signal electrode drivers S are signals with a logical amplitude of −2.5 V to 2.5 V, and data output from level shifter 14 to scanning electrode drivers C are signals with a logical amplitude of −27.5 V to −22.5 V. That is, level shifter 14 converts signals with a logical amplitude of −2.5 V to 2.5 V to signals with a logical amplitude of −27.5 V to −22.5 V. Voltages of 27.5 V, 0 V, −22.5 V and −27.5 V are supplied to scanning electrode drivers C, and voltages of −2.5 V, 0 V, and 2.5 V are supplied to signal electrode drivers S.

As is clear from FIG. 2(*b*), the output voltage from signal electrode drivers S of the present invention, that is, the logical amplitude of the drive voltage for LCD panel 10, is 5 V, composed of signals at a level of −2.5 V to 2.5 V, the same as signals supplied from controller 13. Therefore, a high breakdown voltage transistor and level shift circuit are not necessary for signal electrode drivers S in the present invention. Thus, the area of signal electrode drivers S on the IC chip can be made very small.

A 5-level drive method for simple matrix LCD panel device 22, according to the present invention, will be explained using FIG. 2. Note that to simplify the explanation, the display on LCD panel 10 is two-valued: on/off (white/black).

With alternating current drive in this 5-level drive system, as shown in FIG. 2(*a*), there will be two selection voltages of 27.5 V and −27.5 V for scanning electrodes X. On the other hand, there is only one nonselection voltage of 0 V for scanning electrodes X. There are two voltages, −2.5 V and 2.5 V applied to signal electrodes Y, and these will serve as selection voltage (pixel on) or nonselection voltage (pixel off) depending on the voltage applied to scanning electrodes X.

When the selection voltage of a scanning electrode X is 27.5 V, the selection voltage for a signal electrode Y is −2.5 V. But when the selection voltage of a scanning electrode X is −27.5 V, the selection voltage for a signal electrode Y is 2.5 V. Therefore, 30 V will be applied to the pixel located at the point of intersection of this scanning electrode X and signal electrode Y, and the given pixel will turn on.

On the other hand, when the selection voltage of a scanning electrode X is 27.5 V, the nonselection voltage of a signal electrode Y is 2.5 V. And when the selection voltage of a scanning electrode X is −27.5 V, the nonselection voltage of a signal electrode Y is −2.5 V. Therefore, a voltage of 25 V will be applied to the pixel corresponding to this, and the given pixel will be off. Also, when a nonselection voltage of 0 V is applied to each scanning electrode X, 2.5 V or −2.5 V will be applied to each signal electrode Y, so that a voltage of 2.5 V will be applied to each pixel of each scanning electrode X that is not selected and the given pixel will remain off.

As shown in FIG. 2, with the 5-level drive method used for the simple matrix LCD panel device 22 of the present invention, three types of voltage may be applied to a scanning electrode X of LCD panel 10, and two types of voltage may be applied to a signal electrode Y. Therefore, the construction and control of scanning electrode drivers C and signal electrode drivers S will be simplified. In signal electrode drivers S in particular, the circuit can be constructed with only a 5 V system circuit, so that the area on the IC chip will be small, and the cost of the drivers can be reduced.

Figure 3:
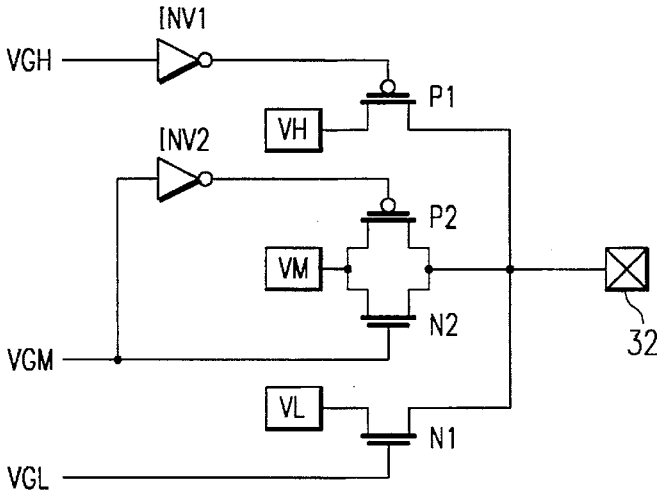
FIG. 3 shows an example of a conventional drive circuit that can supply drive voltage to a scanning electrode X shown in FIG. 2(*a*) .

FIG. 3 shows an example of a conventional drive circuit 30 that can supply the drive voltage shown in FIG. 2(*a*) to scanning electrodes X. Drive circuit 30 is constructed of p-channel MOS transistors P1 and P2, n-channel MOS transistors N1 and N2, and inverters INV1 and INV2. The conduction of each transistor is controlled by control signals VGH, VGM and VGL, and one of three voltage levels, VH, VM, VL, is output to IC chip output pad 32. Note that each transistor is a high breakdown voltage transistor. Here voltages VH, VM and VL are 27.5 V, 0 V, and −27.5 V, respectively, but, of course, other voltages can also be used. In addition, each voltage signal VGH, VGM and VGL controls the conduction of each transistor with two voltages of 27.5 V (logical value H) and −27.5 V (logical value L).

When control signal VHG has a logical value of H, and control signals VGM and VGL have a logical value of L, only transistor P1 conducts, and voltage VH is output to a scanning electrode X via transistor P1 and output pad 32. When control signal VGM has a logical value of H, and control signals VGH and VGL have a logical value of L, only transistors P2 and N2 conduct, and voltage VM is output to a scanning electrode X via transistors P2 and N2 and output pad 32. When control signal VGL has a logical value of H and control signals VGH and VGM have a logical value of L, only transistor N1 conducts, and voltage VL is output to a scanning electrode X via transistor N1 and output pad 32.

Figure 4:
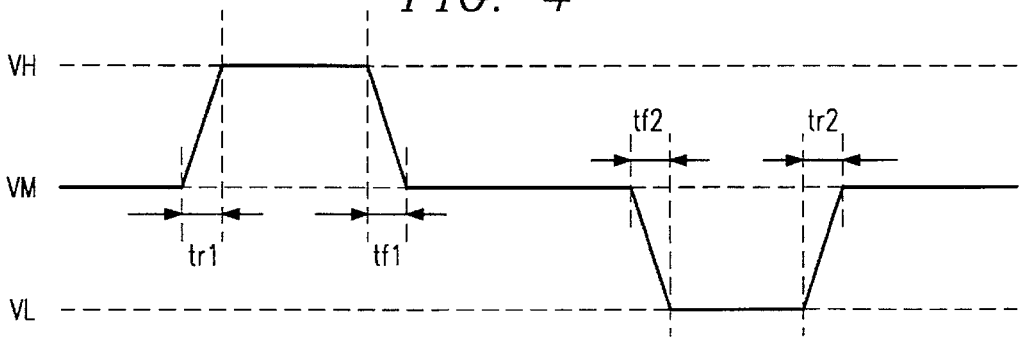
FIG. 4 shows voltage waveforms typically appearing at an output pad 32 of a drive circuit for a scanning electrode X shown in FIG. 2(*a*) .

FIG. 4 shows the voltage waveforms that typically appear at an output pad 32 of a driving circuit for the scanning electrode X of FIG. 2(*a*). In FIG. 4, tr1, tf1, tf2 and tr2 are, respectively, the rise time from voltage VM to voltage VH, the fall time from voltage VH to voltage VM, the fall time from voltage VM to voltage VL, and the rise time from voltage VL to voltage VM. Aforementioned tr1, tf1, tf2 and tr2 have a significant effect on the display picture quality of LCD panel 10, and these must all be made the same value to give good picture quality. Times tr1, tf1, tf2 and tr2 can be regulated by the size of transistors P1, P2, N2 and N1 respectively.

Figure 5:
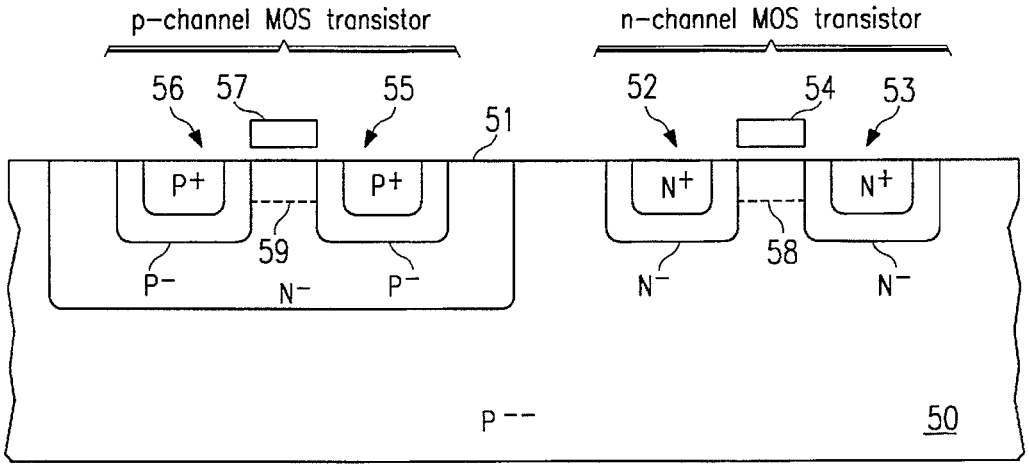
FIG. 5 is a cross section of the major parts of a p-channel MOS transistor and an n-channel MOS transistor formed on a p-type silicon substrate to implement the conventional circuit of FIG. 3.

FIG. 5 shows a cross section of the major parts of a p-channel MOS transistor and an n-channel MOS transistor formed on a p-type silicon substrate. The n-channel MOS transistor is composed of n-type drain 52, n-type source 53 and gate 54, and it is formed on p-type silicon substrate 50. The p-channel MOS transistor is composed of p-type drain 55, p-type source 56 and gate 57, and it is formed in n-type well 51 formed on substrate 50. Drawing the correspondence between FIG. 5 and transistors N2 and P2 in FIG. 3, intermediate potential VM (0 V) is applied to drain 52 and source 56, control signal VGM is applied to gate 54, the inverse signal of control signal VGM is applied to gate 57, and output pad 32 is connected to source 53 and drain 55. Also, voltages of −27.5 V (VL) and 27.5 V (VH) are applied to substrate 50 and well 51, respectively, as power supply voltages. These voltages function as gate reverse bias voltages for the n-channel MOS transistor or p-channel MOS transistor, respectively.

Here, when the breakdown voltages between channel 58 of transistor N2 and substrate 50 and between channel 59 of transistor P2 and well 51 in a conducting state are considered, the breakdown voltage of transistor P2 will be lower than the breakdown voltage of transistor N2. When transistors N2 and P2 are conducting, the potential of channels 58 and 59 is 0 V (VM), the potential of substrate 50 is −27.5 V (VL), and the potential of well 51 is 27.5 V (VH). Therefore, a voltage of 27.5 V will be applied between channel 58 and substrate 50 and between channel 59 and well 51. In this case, a depletion layer will be generated between channel 58 and substrate 50 and between channel 59 and well 51, but the length of this depletion layer will mainly tend toward substrate 50 and well 51, and it will hardly tend toward channels 58 and 59.

Well 51 is formed on substrate 50, so that the impurity concentration of well 51 will be higher than the impurity concentration of substrate 50, and the length of the depletion layer in well 51 will be smaller than the length of the depletion layer in substrate 50. The length of this depletion layer directly affects the breakdown voltages between channel 58 and substrate 50 and between channel 59 and well 51. A depletion layer that extends from the boundary of channel 59 and well 51 to well 51 will be narrower than a depletion layer that extends from the boundary of channel 58 and substrate 50 to substrate 50. Therefore, the breakdown voltage between channel 59 of transistor P2 and well 51 will be lower that the breakdown voltage between channel 58 of transistor N2 and substrate 50 when conducting.

Thus, when the circuit is designed based on the breakdown voltage of transistor N2, margins for fluctuation in the power supply voltage of transistor P2 and variation in production processes will become small.

Designing based on the breakdown voltage of transistor P2, the problems stated above will be solved, but the breakdown voltage of transistor N2 must therefore be raised, leading to increased production costs. Also, making the breakdown voltage between the channel and substrate more than 30 V brings about significant difficulties in the production process.

Note that when transistor N2 is formed on a p-type silicon substrate and transistor P2 is formed in an n-type well formed on a p-type silicon substrate, the breakdown voltage of transistor P2 will be lower than the breakdown voltage of transistor N2. But when transistor P2 is formed on an n-type silicon substrate and transistor N2 is formed in a p-type well formed on an n-type silicon substrate, the breakdown voltage of transistor N2 will be lower than the breakdown voltage of transistor P2. That is, the transistor breakdown voltage is established by the impurity concentration in the semiconductor region where the transistor is formed.

Figure 6:
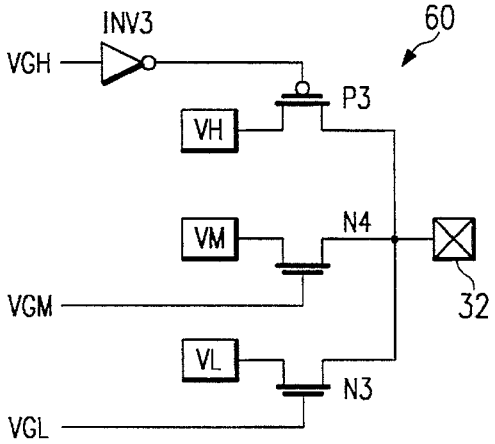
FIG. 6 shows another example of a conventional drive circuit that can supply drive voltage to a scanning electrode X shown in FIG. 2(*a*).

FIG. 6 shows another example of a conventional drive circuit that can supply drive voltage for scanning electrode X shown in FIG. 2*a*. This drive circuit 60 includes a p-channel MOS transistor P3, n-channel MOS transistors N3 and N4, and an inverter INV3. The conduction of each transistor is controlled by control signals VGH, VGM and VGL, and one of three voltage levels, VH, VM, VL, is output to output pad 32. Here, voltages VH, VM and VL are 27.5 V, 0 V, and −27.5 V, respectively, and controls signals VGH, VGM and VGL each control the conduction of each transistor with two logical values of H (27.5 V) and L (−27.5 V). Also, transistors N3 and N4 are formed on a p-type silicon substrate, and transistor P3 formed in an n-type well formed on a p-type silicon substrate.

Drive circuit 60 does not have a p-channel MOS transistor as a transistor that outputs intermediate potential VM, so that there are no problems with the breakdown voltage between the channel of p-channel MOS transistor P2 and the well as in drive circuit 30. Drive circuit 60 can increase the breakdown voltage when the transistor is conducting, but times tf1 and tr2 in FIG. 4 will be greatly changed, and this will lead to deterioration in the display picture quality on LCD panel 10.

The on-resistance of the MOS transistor changes due to the difference in potential of the drain and source. In transistor N4, the drain, source and gate voltages at the start of conduction (on) in tf1 are 0 V (voltage VM), 27.5 V (voltage VH), and 27.5 V (voltage VH), respectively, and in contrast to this, the drain, source and gate voltages at the start of conduction in tr2 are 0 V (voltage VM), −27.5 V (voltage VL) and 27.5 V (voltage VH), respectively. Thus, with tf1, operation starts with transistor N4 at a relatively high on-resistance, and with tr2, operation begins with transistor N4 at a relatively low on-resistance, so that tf1 will be longer than tr2.

Figure 7:
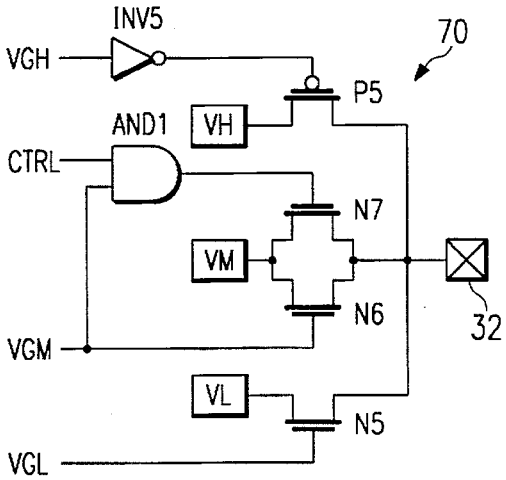
FIG. 7 shows a first embodiment of a drive circuit according to the present invention.
Figure 11:
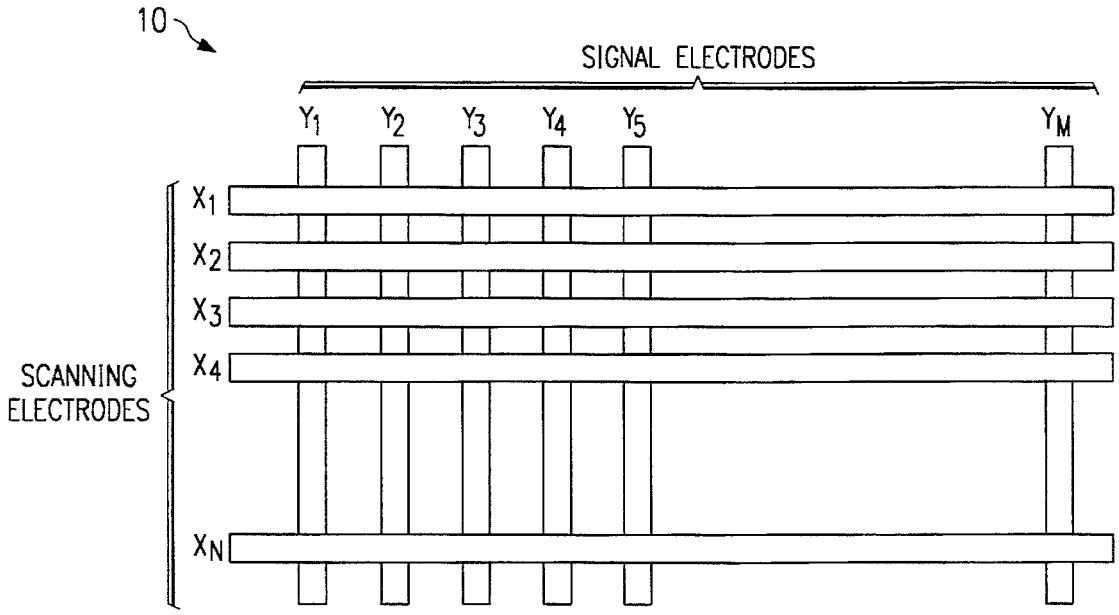
FIG. 11 shows a simple matrix LCD panel.
Figure 12:
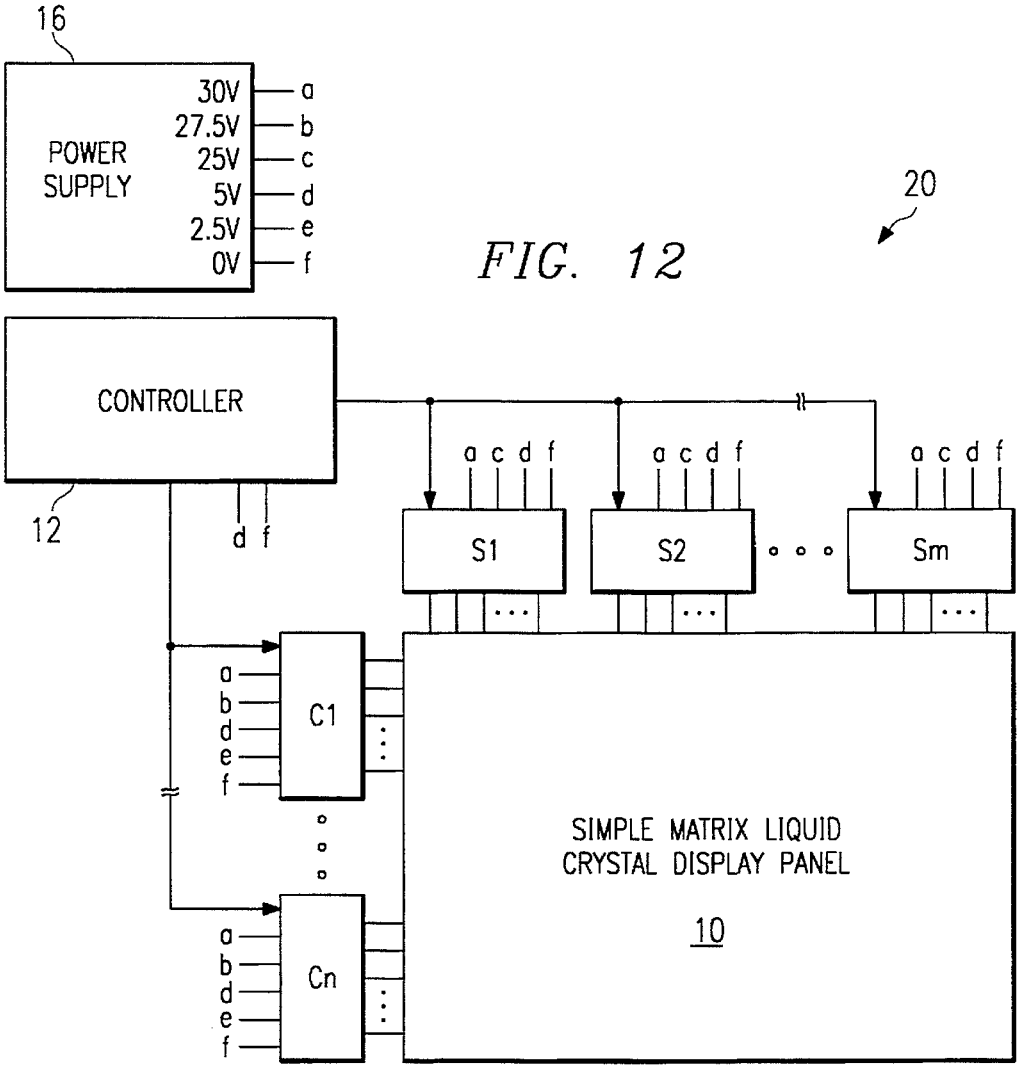
FIG. 12 shows a simple matrix LCD panel device.
Figure 13:
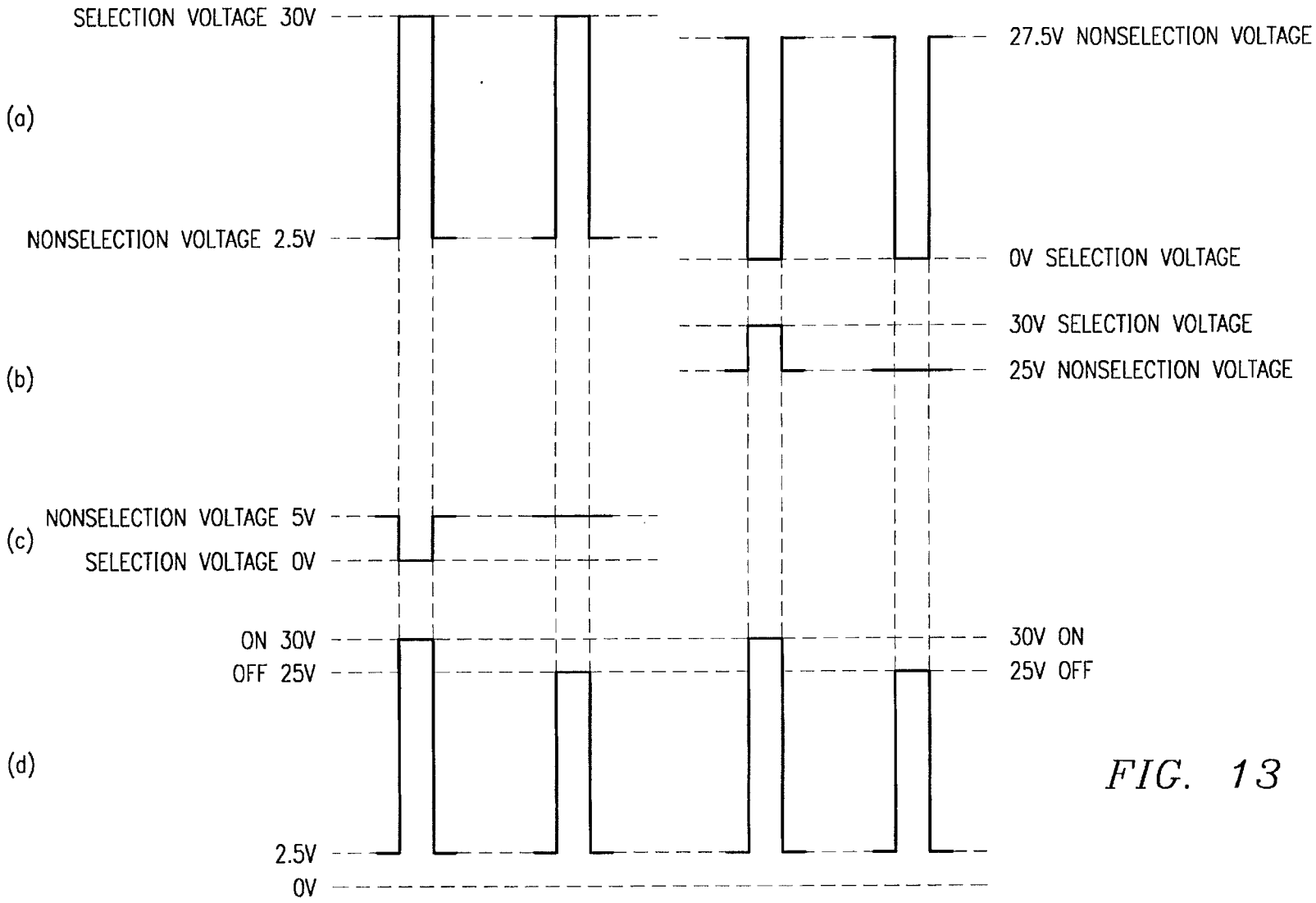
FIG. 13 shows an example of voltage waveforms applied to a scanning electrode X and signal electrode Y of LCD panel 10 in a 6-level drive method.

FIG. 7 shows an example of an improved drive circuit according to the present invention. This drive circuit 70 includes a p-channel MOS transistor P5, n-channel MOS transistors N5, N6 and N7, an inverter INV5 and an AND gate AND1. The conduction of each transistor is controlled by control signals VGH, VGM, VGL and CTRL, and the output to IC chip output pad 32 is one of three voltage levels VH, VM and VL. Note that each transistor has a high breakdown voltage with a double dispersion structure as shown in FIG. 5. Also, voltages VH, VM and VL are 27.5 V, 0 V, and −27.5 V, respectively, and control signals VGH, VGM, VGL and CTRL control the conduction of each transistor with two voltages 27.5 V (logical value of H) or −27.5 V (logical value L). Here, transistors N5, N6 and N7 are formed on a principal face of a p-type silicon substrate, and transistor P5 is formed on a principal face of an n-type well formed on a p-type silicon substrate.

The operation of drive circuit 70 will be explained below by referring to the waveforms of FIG. 4. When control signals VGM and CTRL have a logical value of H and control signals VGH and VGL have a logical value of L, only transistors N6 and N7 conducts, outputting intermediate voltage VM to output pad 32.

Then if the control signals change so that only control signal VGH has a logical value of H and control signals VGM, VGL and CTRL have a logical value of L, only transistor P5 conducts, and the voltage at output pad 32 will rise from intermediate voltage VM to high voltage VH. This output voltage rise time corresponds to tr1 in FIG. 4.

Next if both control signals VGM and CTRL change to a logical value of H, and both control signals VGH and VGL beome a logical value of L, only transistors N6 and N7 conduct, and the voltage at output pad 32 falls back to intermediate voltage VM. The fall time of this output voltage corresponds to tf1 in FIG. 4.

Then if control signal VGL changes to a logical value of H and control signals VGH, VGM, and CTRL all become a logical value of L, only transistor N5 conducts, and voltage at output pad 32 falls from intermediate voltage VM to low voltage VL. The fall time of this output voltage corresponds to tf2 in FIG. 4.

Finally, if control signal VGM becomes a logical value of H, control signals VGH, VGL and CTRL all become a logical value of L, only transistor N6 conducts and the voltage at output pad 32 rises back from low voltage VL to intermediate voltage VL. This output voltage rise time corresponds to tr2 in FIG. 4. When the output voltage reaches voltage VM, control signal CTRL is added to transistor N6 as a logical value of H, so transistor N7 also conducts and voltage VM is stably output to output pad 32.

When the output voltage is changed from voltage VH to voltage VM in this way, transistors N6 and N7 conduct and when the output voltage is changed from voltage VL to voltage VM, only transistor N6 conducts and the on-resistance of the transistor between output pad 32 and voltage VM when the output voltage is changed from VH to voltage VM and the on-resistance of the transistor between output pad 32 and voltage VM when the output voltage is changed from voltage VL to voltage VM are made the same, so that tf1 and tr2 can have the same value. Thus, by controlling the transistor sizes of transistors P5, N5, N6 and N7, tr1, tf1, tf2 and tr2 can easily be made the same value, and the picture quality of LCD panel device 10 can be optimized.

This drive circuit 70 is provided with two n-channel MOS transistors as circuit elements that output intermediate potential VM in parallel, and the conduction of these two transistors is controlled by control signals VGM and CTRL, so that along with maintaining a high breakdown voltage, the output voltage change time can be easily regulated.

A balanced driving signal with equal positive and negative portions of effective voltage and without a DC bias is applied to the pixels of the LCD display. This is important for suppressing burn-out and flicker of the LCD panel.

Also, when voltage VM is output, both transistors N6 and N7 are conducting, so that the transistor on-resistance between voltage VM and output pad 32 is low and output voltage VM is stable.

FIG. 8 shows another embodiment of a drive circuit 80 according to the present invention. Drive circuit 80 includes p-channel MOS transistors P8 and P9, n-channel MOS transistors N8, N9, N10 and N11, inverters INV8 and INV9, and AND gate AND2. The conduction of each transistor is controlled by control signals VGH, VGML, VGL and CTRL, and one of four voltage levels, VH, VMH, VML and VL, is output to IC chip output pad 32. Note that each transistor has a high breakdown voltage with a double dispersion structure as shown in FIG. 5. Also, voltages VH, VMH, VML and VL are, for example, 60 V, 40 V, 20 V and 0 V, respectively, and control signals VGH, VGM, VGL and CTRL control the conduction of each transistor with two voltages of 60 V (logical value H) or 0 V (logical value L). Here, transistors N8, N9, N10 and N11 are formed on the principal face of a p-type silicon substrate, and transistors P8 and P9 are considered to be formed on a principal face of an n-type well formed on a p-type silicon substrate.

When drive circuit 80 outputs voltage VH to output pad 32, control signal VGH will give a logical value of H, control signals VGMH, VGML, VGL and CTRL will give a logical value of L, only transistor P8 conducts, and voltage VH is output to output pad 32 via transistor P8.

When voltage VMH is output to output pad 32, control signal VGMH will give a logical value of H, control signals VGH, VGML, VGL and CTRL will give a logical value of L, only transistors P9 and N11 conduct, and voltage VMH is output to output pad 32 via transistors P9 and N11.

When voltage VL is output to output pad 32, control signal VGL will give a logical value of H, control signals VGH, VGMH, VGML and CTRL will give a logical value of L, only transistor N8 conducts, and voltage VL is output to output pad 32 via transistor N8.

Here, when voltage VML is output to output pad 32 to which voltage VL is supplied, control signal VGML gives a logical value of H, control signals VGH, VGMH, VGL and CTRL give a logical value of L, only transistor N9 conducts, and voltage VML is output to output pad 32 via transistor N9. Note that when output pad 32 reaches voltage VML, both transistors N9 and N10 conduct with control signal CTRL as a logical value of H, and voltage VML is stably supplied to output pad 32. On the other hand, for example, when voltage VML is output to output pad 32 to which voltage VMH is supplied, control signals VGML and CTRL give a logical value of H, control signals VGH, VGMH and VGL give a logical value of L, only transistors N9 and N10 conduct, and voltage VML is output to output pad 32 via transistors N9 and N10.

In this way, when the output voltage changes by falling to VML, two transistors N9 and N10 conduct, and when the output voltage changes by rising to voltage VML, only transistor N9 conducts. The transistor on-resistance between output pad 32 and voltage VML when the output voltage changes by falling to voltage VML and the transistor on-resistance between output pad 32 and voltage VML when the output voltage changes by rising to voltage VML are made equal, so that the rise time and the fall time to voltage VML can be the same.

This drive circuit 80 uses transistors with a CMOS structure for the gates that output voltage VGMH, but it should be constructed so that, when these are constructed with two p-channel MOS transistors and voltage VMH is output to output pad 32, to which voltage VH is supplied, only one of the p-channel MOS transistors will conduct, and when voltage VMH is output to output pad 32, to which voltage VML is supplied, the p-channel MOS transistors will conduct.

FIG. 9 shows a circuit diagram for the level shift circuit in level shifter 14. This level shift circuit 90 is composed of inverters INV11, INV12 and INV13, capacitor C and resistor R. Signals input to input terminal 91 from controller 13 are output from output terminal 92 to scanning electrodes drivers C as level shifts. The logical values H and L of signals input to input terminal 91 are 2.5 V and −2.5 V, respectively, and the logical value H and logical value L of signals output to output terminal 92 are −22.5 V and −27.5 V, respectively. The logical amplitude in each case is 5 V. Also, the power supply voltages of inverter INV11 are 2.5 V and −2.5 V, and the power supply voltages of inverters INV12 and INV13 are −22.5 V and −27.5 V.

Inverter INV11 is a waveform shaping inverter, capacitor C is a capacitor for coupling, and inverters INV12 and INV13 and resistor R constitute a latch circuit. Note that inverters INV11, INV12 and INV13 are CMOS inverters.

FIG. 10 shows signal voltage waveforms for each node A, B, C and D in level shift circuit 90. The operation of level shift circuit 90 will be explained by referring to the waveforms of FIG. 10.

Signals with a logical amplitude of −2.5 V to 2.5 V input to input terminal 91 (node A) are input to inverter INV11, with 2.5 V/−2.5 V as its power supply voltage, and the waveform becomes nearly a square wave and is output to capacitor C (node B). The output signal from this inverter INV11 serves as a latch circuit input signal (node C) whose power supply voltage is −22.5 V/−27.5 V, due to the capacitive coupling of capacitor C. Here, by appropriately selecting the time constant with capacitor C and resistor R, data in which the signal's rising edge or falling edge in node C is latched as a trigger is set or reset.

This latch circuit has −22.5 V/−27.5 V as the power supply voltage, so by fetching the output signal of this latch circuit (node D), a signal of −2.5 V to 2.5 V can be level shifted to a signal of −27.5 V to −22.5 V.

In this way, with level shift circuit 90, signals whose signal amplitude voltage values are different can easily be level shifted with a simple circuit construction. The logical amplitude of the input signals in this level shift circuit 90 is −2.5 V to 2.5 V, and the logical amplitude of the output signals is −27.5 V to −22.5 V, but they are not necessarily limited to these logical amplitudes, and level shifting between signals with any voltage difference is possible. In particular, when the logical amplitude of the input signal is greater than or equal to the logical amplitude of the output signal, level shifting can be achieved without changing this circuit.

Also, one example of the capacitance value for capacitor C and the resistance value for resistor R is R=100 KΩ and C=100 pF, and a change in the constant value coordinated with the circuit characteristics, e.g., inverter threshold voltage, etc., is necessary.

Also, level shift circuit 90 is composed of coupling capacitor C and a latch circuit. Since coupling capacitor C transmits only the edge portion of a square wave, and the latch circuit sets or resets latch data according to this edge portion, level shift operation can be achieved regardless of the differences in potential between the input signals and the output signals. Also, since all the circuit elements except for capacitor C operate with 5 V amplitude signals, the level shift circuit can be realized without using circuit elements that have high breakdown voltage, power consumption will be low, and the circuit will also have a high response speed.

The distinctive drive circuit according to the present invention has a first transistor of a first conductivity type that outputs a first voltage to an output terminal by conducting, a second transistor of a second conductivity type that outputs a second voltage to the output terminal by conducting, a third transistor of a second conductivity type that outputs a third voltage intermediate between the first voltage and the second voltage to the output terminal by conducting, or a fourth transistor of a second conductivity type that outputs the third voltage to the output terminal by conducting. When the voltage of the output terminal changes to the third voltage from the first voltage, the third and fourth transistors conduct, and when the voltage of the output terminal changes to the third voltage from the second voltage, only the third transistor conducts.

Furthermore, in the distinctive drive circuit according to the present invention, the second, third and fourth transistors are formed on a principal face in a semiconductor region of a first conductivity type, and the first transistor is formed on a principal face in a semiconductor region of a second conductivity type formed in the semiconductor region of the first conductivity type.

Note that the drive circuit discussed above according to the present invention illustrates an example of the technical concepts of the present invention. Its circuit construction, output voltages, etc., are not limited to the examples discussed above, and it can be modified in various ways based on the technical concepts of the present invention.

In the drive circuit of the present invention, there are at least two MOS transistors installed on the principal face of a semiconductor region of the same conductivity type as the circuit that supplies the desired voltage, placed between power supply voltages, to an output terminal, one or both of the MOS transistors are made to conduct and supply the desired voltage to an output terminal where there is no specific voltage value. Therefore, the rise and fall characteristics of the output terminal to the desired values can be made the same while high breakdown voltage is maintained. Also, since a CMOS structure is not used as the circuit that supplies voltage, placed between power supply voltages, to an output terminal, the area occupied by the drive circuit on an IC chip can be made small.

I claim:

1. A CMOS driving circuit for a capacitive load, which produces a three-level, symmetrical AC scanning voltage waveform having opposed large amplitude HIGH and LOW voltages for column-select and a GROUND voltage for column-nonselect, comprising:

HIGH, LOW, and GROUND supply terminals respectively for receiving opposed large amplitude HIGH and LOW voltages and a GROUND voltage;

separate inputs for HIGH-SELECT, LOW-SELECT, and GROUND-SELECT signals, each of which can be either at the HIGH or LOW voltage, and a common output;

a p-channel MOSFET normally OFF but responsive to the HIGH-SELECT signal being HIGH for coupling the HIGH terminal to the common output;

a discharging circuit having a pair of n-channel MOSFETs for coupling the GROUND terminal to the common output when the GROUND-SELECT signal is HIGH, and an AND gate for disabling one of the pair of n-channel MOSFETs from such coupling when the common output is at a voltage lower than GROUND; and an individual n-channel MOSFET, normally OFF but responsive to the LOW-SELECT signal being HIGH for coupling the LOW terminal to the common output;

whereby the rise and fall times of the scanning voltage waveform are kept the same without sacrificing a high breakdown voltage.

2. The driving circuit of claim 1 wherein:

the circuit is formed on a p-type semiconductor substrate coupled to the LOW voltage; and the p-type MOSFET is formed in an n-type well on the p-type substrate coupled to the HIGH voltage.

3. The driving circuit of claim 1 further comprising:

a second CMOS driving circuit for a capacitive load, which produces a two-level AC pixel signal voltage waveform synchronized to the AC scanning voltage waveform and having opposed small amplitude ON and OFF voltages respectively for activating or not activating pixels in a column of pixels selected by the AC scanning voltage waveform.

* * * * *